US009712902B1

(12) United States Patent
Uziel et al.

(10) Patent No.: US 9,712,902 B1
(45) Date of Patent: Jul. 18, 2017

(54) SPEAKER BALL WITH ANTI-ROLL FEATURE

(71) Applicant: MiWorld Accessories LLC, New York, NY (US)

(72) Inventors: Judah Uziel, New York, NY (US); Uran Kamfer, New York, NY (US); Andrew Kanakis, New York, NY (US)

(73) Assignee: MIWORLD ACCESSORIES LLC, New York, NY (US)

( * ) Notice: Subject to any disclaimer, the term of this patent is extended or adjusted under 35 U.S.C. 154(b) by 24 days.

(21) Appl. No.: 14/995,546

(22) Filed: Jan. 14, 2016

(51) Int. Cl.
*H04R 1/02* (2006.01)
*H04R 1/32* (2006.01)

(52) U.S. Cl.
CPC ..... *H04R 1/026* (2013.01); *H04R 1/023* (2013.01); *H04R 1/323* (2013.01)

(58) Field of Classification Search
CPC ..... H04R 1/026; H04R 1/023; H04R 1/323
See application file for complete search history.

(56) References Cited

U.S. PATENT DOCUMENTS

| | | | | |
|---|---|---|---|---|
| 3,720,787 | A | 3/1973 | Ishii | |
| 4,662,260 | A * | 5/1987 | Rumsey | A63H 5/00 446/408 |
| 4,737,134 | A * | 4/1988 | Rumsey | A63H 5/00 446/175 |
| 4,953,223 | A | 8/1990 | Householder | |
| 6,856,692 | B2 | 2/2005 | Lin | |
| D593,543 | S | 6/2009 | Lui | |
| D597,532 | S | 8/2009 | Wang | |
| 7,796,775 | B2 | 9/2010 | Oxford | |
| 8,068,618 | B2 | 11/2011 | Vollmer | |
| D667,389 | S | 9/2012 | Yokoyama | |
| D676,423 | S | 2/2013 | Joseph | |
| D711,351 | S | 8/2014 | Breines | |
| D726,157 | S | 4/2015 | Chang | |

FOREIGN PATENT DOCUMENTS

| | | |
|---|---|---|
| CN | 2322338 | 6/1999 |
| CN | 201854406 | 6/2011 |
| JP | H11-122686 | 4/1999 |
| JP | 2009-060198 | 3/2009 |
| JP | 2012-124876 | 6/2012 |

OTHER PUBLICATIONS

Jordan Guelde, Sphere Chairs, http://www.coroflot.com/jguelde13/sphere-chairs, Dec. 2007.

* cited by examiner

*Primary Examiner* — Muhammad N Edun
(74) *Attorney, Agent, or Firm* — Notaro, Michalos & Zaccaria P.C.

(57) ABSTRACT

A speaker ball with housing with spherical outer surface, defines an interior volume. A button with a segment of the spherical surface is movable from a first position where the segment is held contiguous with the spherical surface, to a second inward position, that leaves a circular contact ring on which the speaker ball can rest without rolling. An audio driver is in the interior volume for generating sound and a toggle mechanism connected between the button and a remainder of the housing alternately holds the button in its first position and allows the button to move to its second position when the button is repeatedly pressed and released.

18 Claims, 5 Drawing Sheets

SPEAKER BALL WITH ANTI-ROLL FEATURE

FIELD AND BACKGROUND OF THE INVENTION

The present invention relates generally to the field of audio speakers, and in particular to a new and useful speaker unit having a spherical, ball shape in one mode of use, for example, for floating in a swimming pool, and a second mode of use with a bottom segment of the spherical shape indented into the body of the unit to leave a circular contact ring on which the unit can rest on a flat surface, without rolling.

Ball shaped speaker units are known. See for example, U.S. Pat. No. 3,720,787 to Ishii et al., U.S. Pat. No. 6,856,692 to Lin and U.S. Pat. No. 8,068,618 to Vollmer. If placed on a flat surface, these units would roll around at random and perhaps fall off a surface and be damaged.

Ball shaped speaker units having one flat surface are also known that would resist rolling around if placed on a flat surface. See for example, U.S. Pat. D593,543 to Lui, U.S. Pat. D676,423 to Joseph and U.S. Pat. D726,157 to Chang. These have no fully spherical shape, however, so they are missing the esthetic of a fully spherical speaker ball.

A line of furniture called "Sphere Chairs" by Jordan Guelde are known as of December 2007 at website http://www.coroflot.com/jgueldel3/sphere-chairs which include two nested arm chairs that form a sphere, with each having a spring loaded bottom segment that is pushed in when each chair is placed right-side-up, to create a flattened contact area at the bottom so the chairs do not roll around. There is no selection of which mode, i.e. flat-bottomed or spherical, to choose as the segment is pushed in by gravity only. Also, such furniture is well outside the art of speaker design and considerations.

SUMMARY OF THE INVENTION

It is an object of the present invention to provide a speaker ball that can easily and quickly be converted from a first fully spherical ball mode for freely floating in a pool of water such as a swimming pool, to a second anti-rolling mode that allows it to securely rest on a flat surface like a table top, a counter top or the ground, without rolling around.

Another object of the invention is to provide a speaker ball that comprises a housing with a spherical outer surface and defining an interior volume, a button with a segment of the spherical surface movable from a first position where the segment is held contiguous with the spherical surface, to a second inward position, that leaves a circular contact ring on which the speaker ball can rest without rolling, an audio driver in the interior volume for generating sound, and a toggle mechanism connected between the button and a remainder of the housing for alternately holding the button in the first position and for allowing the button to move to the second position when the button is repeatedly pressed and released.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
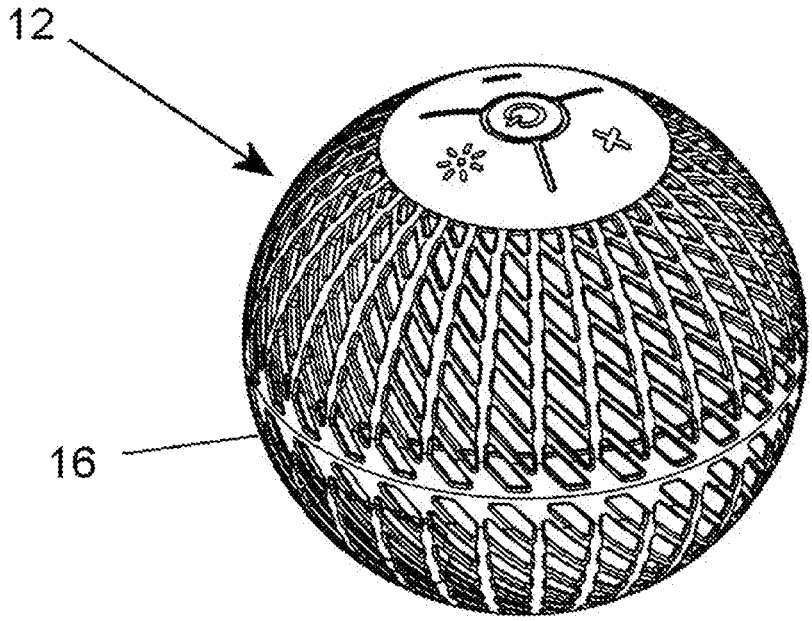
FIG. 1 is a top perspective view of a speaker ball with anti-roll feature according to the invention.

Referring now to the drawings, in which like reference numerals are used to refer to the same or similar elements, FIGS. 1, 2, 3 and 10 illustrate a speaker ball comprising a housing 12 having a spherical outer surface and defining an interior volume. The housing 12 has a push button 14 that carries a segment of the outer spherical surface, the button being mounted for movement from a first position shown in FIG. 2, where the segment is contiguous with the spherical outer surface, to a second position shown in FIG. 10, that is inward of the interior volume with respect to a remainder 16 of the housing 12, where the segment lies within a plane defined by a circle or circular contact ring 12*a* that remains when the button 14 is in its second position.

In the first position of button 14, the speaker ball housing 12 is fully spherical and, being water tight and buoyant, can be thrown into a swimming pools, for example, so that music can be heard from the ball as it floats around. In the second position of the button 14, the circle or ring 12*a* defines the circular contact ring on which the speaker ball can rest on a flat surface like a table, counter top or the ground, without rolling around.

Figure 2:
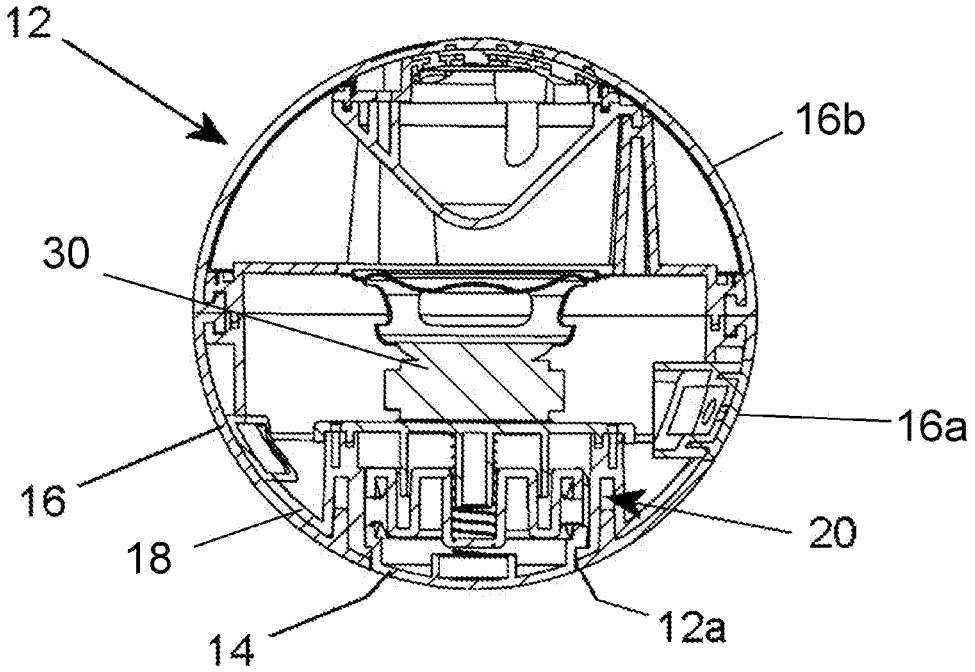
FIG. 2 is a vertical sectional view taken through the center of the speaker ball of FIG. 1 in its first position or mode of use, in a spherical ball shape.
Figure 3:
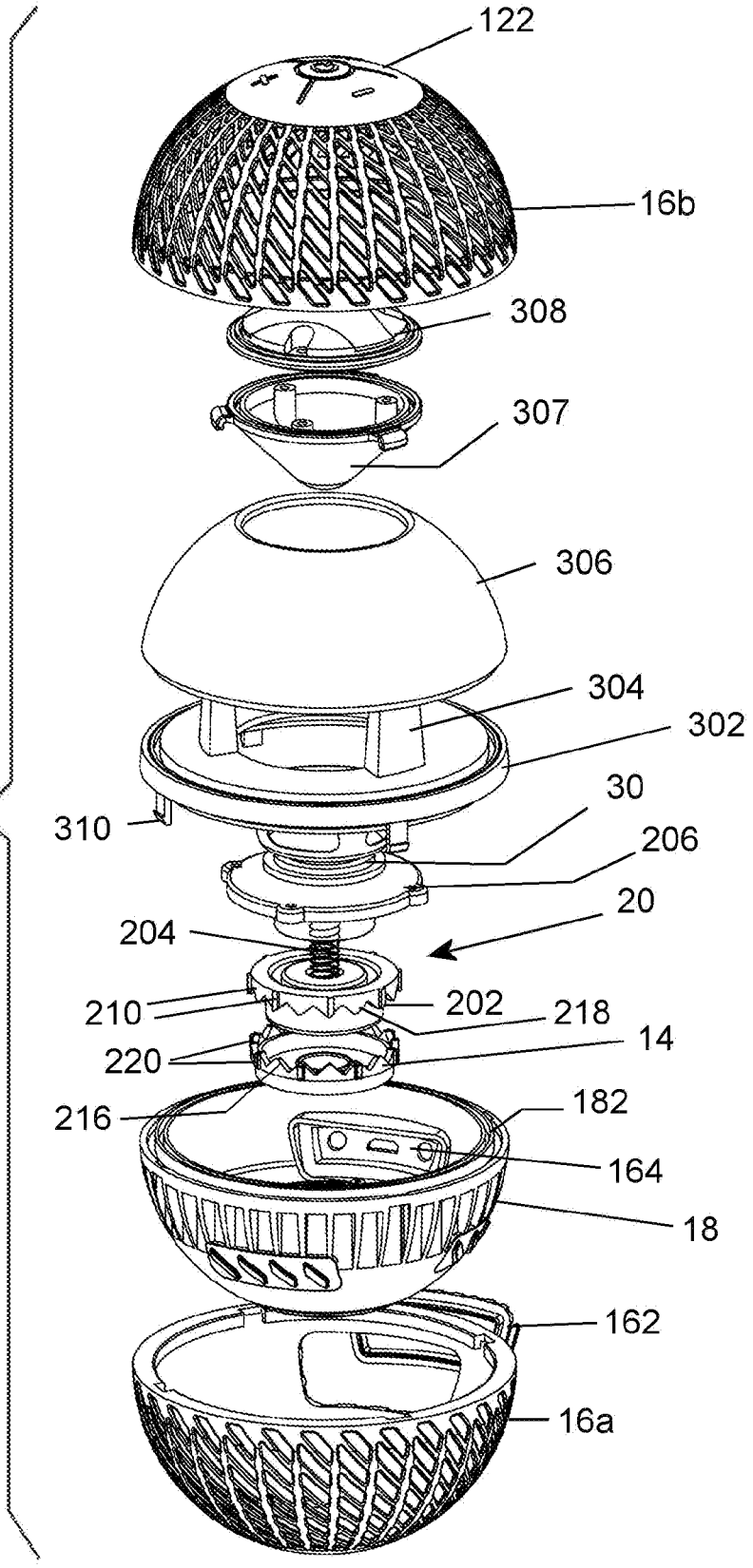
FIG. 3 is an exploded view of the speaker ball showing its components in top perspective.

An audio driver 30 shown in FIGS. 2 and 3 is mounted in the interior volume of housing 12 for generating sound for emanating out of the housing, and a toggle mechanism 20 is operatively connected between the button 14 and the remainder 16 of the housing 12 for alternately holding the button in the first position and for allowing the button to move to the second position.

With reference to FIG. 3, the components of the speaker ball include a lower outer shell 16*a* which contains a lower inner shell 18. Inner shell 18 is snapped into outer lower shell 16*a* and carries the push button 14, the toggle mechanism 20 and connects to other components of the invention.

The toggle mechanism 20 includes a cog-wheel 202, a spring 204 and a cover 206. As will be explained later in this disclosure, the button 14 and cog-wheel 202, cooperate with a cam ring 208 shown in FIG. 5, formed as part of the inner shell 18 to incrementally rotate the button 14 each time the button is pressed, to cycle through a push/release operation to move it between its first and second positions.

The audio driver 30 rests on or is spaced above the cover 206 and is mounted with suitable clips within a seal plate 302 which is part of a mesh dome assembly including struts 304 which connect a metal mesh dome 306 to the seal plate 302.

A sound spreading cone 307 is mounted inside dome 306 and is covered by a cover plate 308. The purpose of cone 307 is to deflect upwardly directed sound waves from audio driver 30, outwardly through the mesh dome 306 and through the upper outer shell 16*b* of the speaker ball housing.

Figure 5:
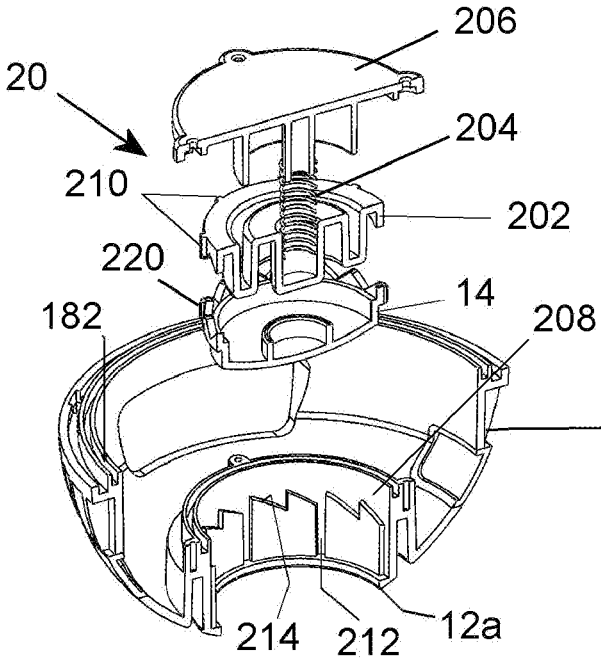
FIG. 5 is a partial perspective view of the lower shell of the speaker ball housing and the parts of its toggle mechanism of FIG. 3, in exploded view.

With reference to FIGS. 3 and 5, an upper ring area 182 of the inner shell 18 mates with a ring surface of seal plate 302 and is firmly engaged to the seal plate by tabs 310 that are inserted into suitably provided slots in the inner shell 18 to produce a water tight seal that excludes water from the inner volume of the housing 12. Controls 122 in the form of rubber covered embossed areas at the top of the outer shell 16*b* can be used to activate the speaker and increase and decrease volume.

A door 162 is connected by a water tight seal into an opening in the lower shell 16*a* and carries a connection plate 164 for connecting a recharging cable, an auxiliary cable and a headphone speaker cable.

Figure 6:
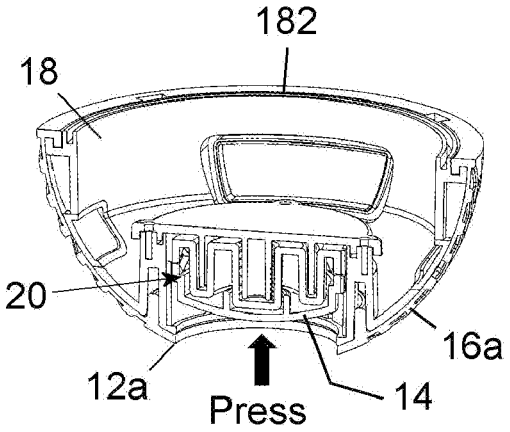
FIG. 6 is a partial perspective view of the lower shell of the speaker ball housing with its toggle mechanism of FIG. 3, assembled and its push button being pressed into the interior volume of the housing toward its second position.
Figure 7:
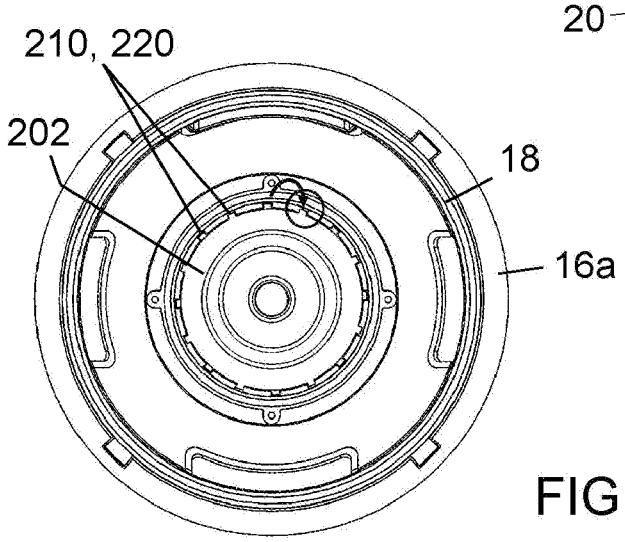
FIG. 7 is a top plan view of the lower shell with parts of its toggle mechanism of FIG. 3, showing how various inclined tooth and cam surfaces of the toggle mechanism interact to rotate the push button during each press and release cycle.

Referring now to FIGS. 3 and 5-10, each time button 14 is pushed upwardly as shown in FIG. 6, it raises the cog wheel 202. Teeth 210 spaced around the large diameter outer ring of cog wheel 202 ride upwardly in slots 212 on the inner surface of cam ring 208. This movement is coordinated with the engagement of cogs 216 in push button 14 with cogs 218 at the lower perimeter of the outer ring 202 to incrementally rotate the cog wheel 202 with respect to the button 18 as the teeth in the cog wheel clear the top of the slots 212. Due to this rotation and the downward biasing of spring 204, the teeth of cog wheel 202 engage onto incline surfaces 214 on top cams inside cam ring 208.

Figure 8:
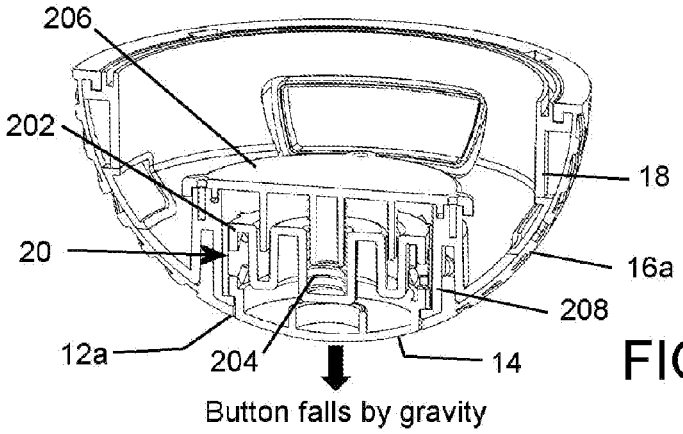
FIG. 8 is a partial perspective view of the lower shell of the speaker ball housing and the toggle mechanism of FIG. 3, in the second position of the push button for effecting the second mode of operation that allows the speaker ball to rest on a flat surface without rolling.
Figure 9:
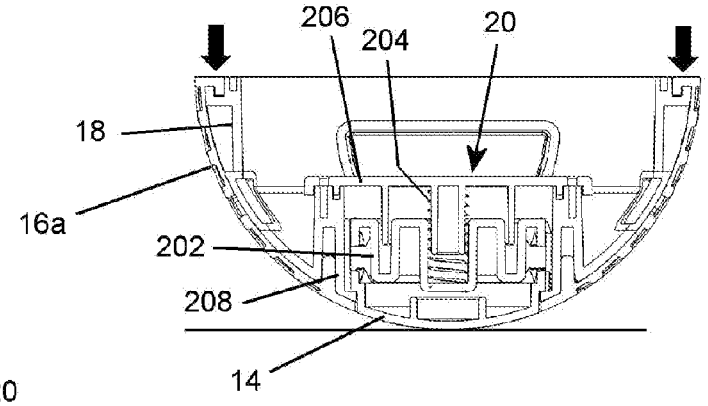
FIG. 9 is a side sectional view of the lower shell of the speaker ball housing and the toggle mechanism of FIG. 3, as the speaker ball is being lowered onto a flat surface and just before the push button is pushed into the housing interior volume under the weight of the speaker ball.
Figure 10:
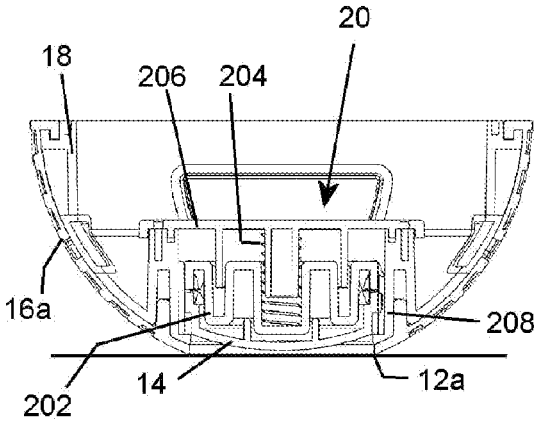
FIG. 10 is a side sectional view of the lower shell of the speaker ball housing and the toggle mechanism of FIG. 3, when the speaker ball is resting on the flat surface and will not roll since the weight of the speaker ball is distributed along the circular contact ring at the bottom of the housing that has been exposed by the free movement of the push button into the housing.

Teeth 210 resting on surfaces 214, hold the cog wheel 202 in an upward position as shown in FIG. 8, while the button can fall by gravity in an unbiased manner. In this way, the spherical segment of button 14 will be contiguous with the outer spherical surface of the remainder of the housing at 16*a* for an anesthetic purpose. If then the ball is placed on a flat surface as shown in FIG. 9, gravity in the direction of the heavy downward arrows will allow the ball to sink, thereby pushing the button 14 upwardly as shown in FIG. 10. In this position, the circle or contact ring 12*a* rests on the flat surface and prevents the speaker ball from rolling around.

To return the push button 14 to its first downward position, it is pressed upwardly again thereby causing further rotation of the cog wheel 202 by virtue of the meshing cogs 216, 218 which returns the teeth 210 to alignment with the slots 212. Under the biasing force of spring 204 the cog wheel 202 then returns to its lower position, biasing the push button 14 to its first position for the spherical mode of the speaker ball.

Figure 4:
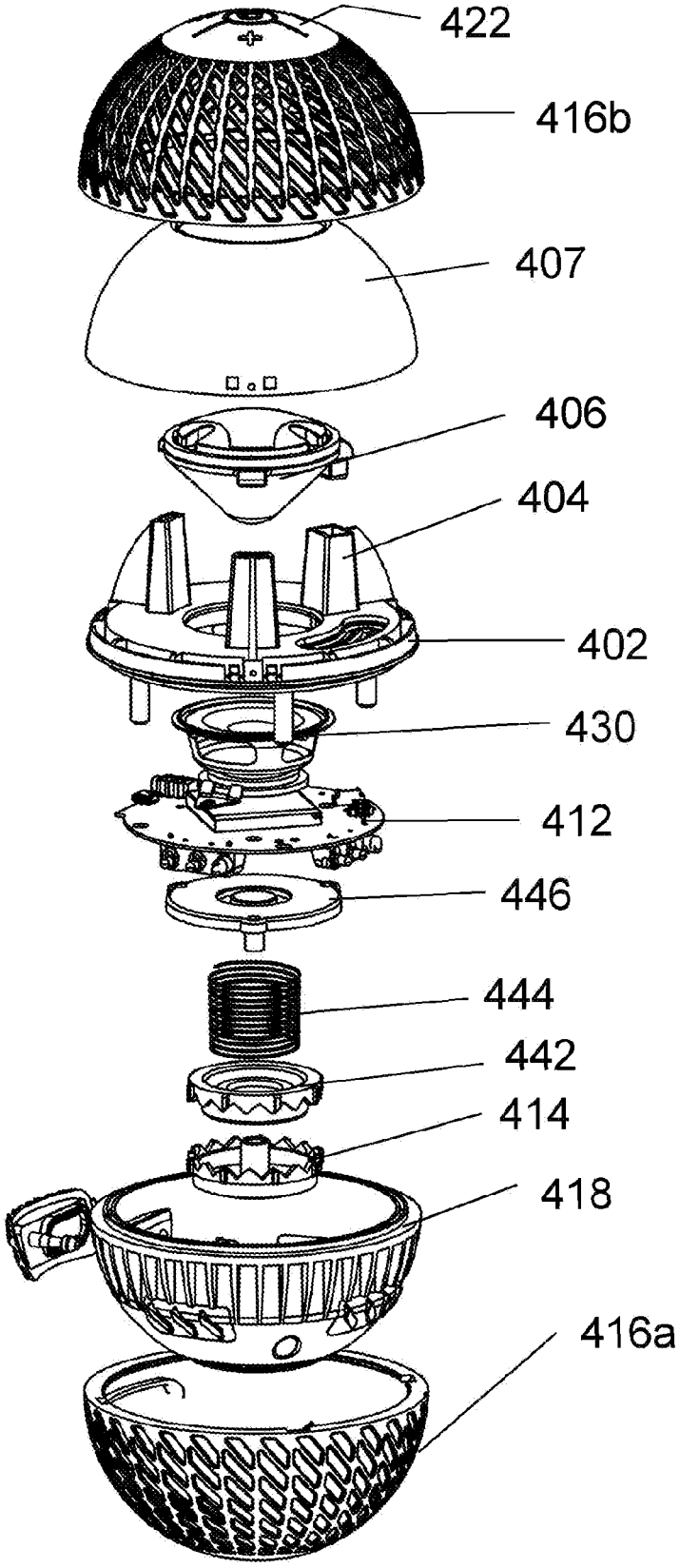
FIG. 4 is an exploded view of another embodiment of the speaker ball showing its components in top perspective.

Referring to FIG. 4 which shows a second embodiment of the invention, the speaker ball includes a spherical outer shell comprising a lower shell 416*a* which is connected in a water tight manner to an upper shell 416*b* and which defines an interior volume containing, from the bottom upwardly, a lower inner shell 418, a push button 414, a cam wheel 442, a biasing spring 444, a toggle mechanism cover plate 446, a circuit plate 402 mounted above the toggle cover 446, the plates 402 and 446 being fixed within the housing, and an audio driver 430 mounted above the circuit plate 402.

As with the embodiment of FIG. 4 requires the cam wheel 442 to be slidably engaged with the button 414 to be movable upwardly and downwardly and to include teeth and cogs which incrementally rotate the upper cog wheel 442 each time the button 414 is pressed and toggled between its first and second positions.

A heavier spring 444 is utilized to bias the button 414 downwardly in the first, all spherical mode of operation.

As with the embodiment of FIG. 1, the embodiment of FIG. 4 includes a ceiling plate 402 which works with the inner shell 418 to establish a water tight seal, struts 404 which support a mesh dome 406 which is permeable to sound that has been redirected from a speaker of audio drive 430 against the conical surface of a cone 407 and out through the mesh 406.

Controls 422 are provided on the top of the speaker ball as with the embodiment of FIG. 1.

While specific embodiments of the invention have been shown and described in detail to illustrate the application of the principles of the invention, it will be understood that the invention may be embodied otherwise without departing from such principles.

What is claimed is:

1. A speaker ball comprising:

a housing (12) having a spherical outer surface and defining an interior volume, the housing having a button (14) that carries a segment of the spherical surface, the button being mounted for movement from a first position where the segment is contiguous with the spherical surface, to a second position, inwardly of the interior volume with respect to a remainder (16) of the housing (12), where the segment lies within a plane defined by a circle (12*a*) remaining when the button (14) is in the second position, the circle (12*a*) defining a circular contact ring on which the speaker ball can rest on a flat surface, without rolling;

an audio driver (30) in the interior volume for generating sound for emanating out of the housing; and a toggle mechanism (20) operatively connected between the button (14) and the remainder (16) of the housing (12) for alternately holding the button in the first position and for allowing the button to move to the second position.

2. A speaker ball according to claim 1, wherein the remainder of the housing comprises a lower shell (16*a*)

defining the circle (12*a*), and an upper shell (16*b*) connected to the lower shell at a water tight seal.

3. A speaker ball according to claim 1, wherein the toggle mechanism (20) comprises a cam ring (208) fixed to the housing in the interior space, a cog wheel (202) having teeth (210) engaged to the cam ring (208) and movable with the button (14) along the cam ring for movement between upwardly locked and lower unlocked positions in the cam ring, corresponding respectively to the first and second positions of the button (14) when the button is repeatedly pressed and released, and a spring (204) for biasing the cog wheel toward the button.

4. A speaker ball according to claim 1, wherein the toggle mechanism (20) comprises a cam ring (208) fixed to the housing in the interior space, the cam ring having vertical slots and inclined cam surfaces at the top of each slot, a cog wheel (202) having teeth (210) engageable in the slots and movable along the inclined cam surfaces, the cog wheel being movable with the button (14) along the cam ring for movement between an upwardly locked position with the teeth on the inclined surfaces, and a lower unlocked position with the teeth in the slots, the button and the cog wheel having facing cogs (216, 218) that engaged each other as the button moves into engagement with the cog wheel, for incrementally rotating the cog wheel when the teeth pass a top of each slot to rotate onto one of the cam surfaces of the cam ring, and a spring (204) for biasing the cog wheel toward the button.

5. A speaker ball according to claim 1, wherein the remainder of the housing comprises a lower shell (16*a*) defining the circle (12*a*), and an upper shell (16*b*) connected to the lower shell at a water tight seal, the toggle mechanism (20) comprising a cam ring (208) fixed to the housing in the interior space, a cog wheel (202) having teeth (210) engaged to the cam ring (208) and movable with the button (14) along the cam ring for movement between upwardly locked and lower unlocked positions in the cam ring, corresponding respectively to the first and second positions of the button (14) when the button is repeatedly pressed and released, and a spring (204) for biasing the cog wheel toward the button.

6. A speaker ball according to claim 1, including a sound spreading cone (307) in the interior volume, above the audio driver (30) and a mesh dome (306) covering the cone.

7. A speaker ball according to claim 1, including a toggle mechanism cover plate (206) fixed to the housing above the toggle mechanism (20), the audio driver (30) being above the toggle mechanism cover plate (206).

8. A speaker ball according to claim 1, including a sound spreading cone (307) in the interior volume, above the audio driver (30) and a mesh dome (306) covering the cone, and a toggle mechanism cover plate (206) fixed to the housing above the toggle mechanism (20), the audio driver (30) being above the toggle mechanism cover plate (206).

9. A speaker ball according to claim 1, wherein the remainder of the housing comprises a lower shell (16*a*) defining the circle (12*a*), and an upper shell (16*b*) connected to the lower shell at a water tight seal, the toggle mechanism (20) comprising a cam ring (208) fixed to the housing in the interior space, a cog wheel (202) having teeth (210) engaged to the cam ring (208) and movable with the button (14) along the cam ring for movement between upwardly locked and lower unlocked positions in the cam ring, corresponding respectively to the first and second positions of the button (14) when the button is repeatedly pressed and released, and a spring (204) for biasing the cog wheel toward the button, the speaker ball including a sound spreading cone (307) in the interior volume, above the audio driver (30) and a mesh dome (306) covering the cone, and a toggle mechanism cover plate (206) fixed to the housing above the toggle mechanism (20), the audio driver (30) being above the toggle mechanism cover plate (206).

10. A speaker ball comprising a housing with a spherical outer surface and defining an interior volume, a button with a segment of the spherical surface movable from a first position where the segment is held contiguous with the spherical surface, to a second inward position, that leaves a circular contact ring on which the speaker ball can rest without rolling, an audio driver in the interior volume for generating sound, and a toggle mechanism connected between the button and a remainder of the housing for alternately holding the button in the first position and for allowing the button to move to the second position when the button is repeatedly pressed and released.

11. A speaker ball according to claim 10, wherein the housing comprises a lower shell defining the circular contact ring, and an upper shell connected to the lower shell at a water tight seal.

12. A speaker ball according to claim 10, wherein the toggle mechanism comprises a cam ring fixed in the housing, a cog wheel engaged to the cam ring and movable with the button along the cam ring for movement between upwardly locked and lower unlocked positions in the cam ring, corresponding respectively to the first and second positions of the button, and a spring for biasing the cog wheel toward the button.

13. A speaker ball according to claim 10, wherein the toggle mechanism comprises a cam ring fixed in the housing, the cam ring having vertical slots and inclined cam surfaces at the top of each slot, a cog wheel having teeth engageable in the slots and movable along the inclined cam surfaces, the cog wheel being movable with the button along the cam ring for movement between an upwardly locked position with the teeth on the inclined surfaces, and a lower unlocked position with the teeth in the slots, the button and the cog wheel having facing cogs that engaged each other as the button moves into engagement with the cog wheel, for incrementally rotating the cog wheel when the teeth pass a top of each slot to rotate onto one of the cam surfaces of the cam ring, and a spring for biasing the cog wheel toward the button.

14. A speaker ball according to claim 10, wherein the housing comprises a lower shell defining the circular contact ring, and an upper shell connected to the lower shell at a water tight seal, the toggle mechanism comprising a cam ring fixed in the housing, a cog wheel engaged to the cam ring and movable with the button along the cam ring for movement between upwardly locked and lower unlocked positions in the cam ring, corresponding respectively to the first and second positions of the button, and a spring for biasing the cog wheel toward the button.

15. A speaker ball according to claim 10, including a sound spreading cone in the housing above the audio driver, and a mesh dome covering the cone.

16. A speaker ball according to claim 10, including a toggle mechanism cover plate fixed in the housing above the toggle mechanism, the audio driver being above the toggle mechanism cover plate.

17. A speaker ball according to claim 10, including a sound spreading cone in the housing above the audio driver, and a mesh dome covering the cone, and a toggle mechanism cover plate fixed in the housing above the toggle mechanism, the audio driver being above the toggle mechanism cover plate.

18. A speaker ball according to claim 10, wherein the toggle mechanism comprises a cam ring fixed in the housing, the cam ring having vertical slots and inclined cam surfaces at the top of each slot, a cog wheel having teeth engageable in the slots and movable along the inclined cam surfaces, the cog wheel being movable with the button along the cam ring for movement between an upwardly locked position with the teeth on the inclined surfaces, and a lower unlocked position with the teeth in the slots, the button and the cog wheel having facing cogs that engaged each other as the button moves into engagement with the cog wheel, for incrementally rotating the cog wheel when the teeth pass a top of each slot to rotate onto one of the cam surfaces of the cam ring, and a spring for biasing the cog wheel toward the button, a sound spreading cone in the housing above the audio driver, and a mesh dome covering the cone.

* * * * *